US009343197B2

(12) United States Patent
Honda et al.

(10) Patent No.: US 9,343,197 B2
(45) Date of Patent: May 17, 2016

(54) INSULATED WIRE AND COIL

(71) Applicant: HITACHI CABLE, LTD., Tokyo (JP)

(72) Inventors: Yuki Honda, Hitachi (JP); Takami Ushiwata, Hitachi (JP); Shuta Nabeshima, Hitachi (JP); Hideyuki Kikuchi, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 190 days.

(21) Appl. No.: 13/689,635

(22) Filed: Nov. 29, 2012

(65) Prior Publication Data

US 2013/0161065 A1 Jun. 27, 2013

(30) Foreign Application Priority Data

Dec. 22, 2011 (JP) ..... 2011-280844

(51) Int. Cl.
*H01B 7/00* (2006.01)
*H01B 3/30* (2006.01)
*H01B 3/42* (2006.01)

(52) U.S. Cl.
CPC ..... *H01B 3/30* (2013.01); *H01B 3/306* (2013.01); *H01B 3/421* (2013.01)

(58) Field of Classification Search
CPC ..... H01B 7/0208
USPC ..... 174/120 R
See application file for complete search history.

(56) References Cited

U.S. PATENT DOCUMENTS

| | | | | | |
|---|---|---|---|---|---|
| 3,105,775 | A * | 10/1963 | Lavin | C09D 129/14 | 427/120 |
| 3,493,413 | A * | 2/1970 | Filius et al. | 428/383 | |
| 4,495,321 | A * | 1/1985 | Arnold | 524/104 | |
| 4,801,501 | A * | 1/1989 | Harlow | H01B 7/0208 | 174/120 SR |
| 5,201,903 | A * | 4/1993 | Corbett et al. | 29/872 | |
| 5,965,263 | A * | 10/1999 | Tatematsu et al. | 428/383 | |
| 6,350,844 | B1 * | 2/2002 | Ono et al. | 528/170 | |
| 8,314,203 | B2 * | 11/2012 | Tsutsumi et al. | 528/310 | |
| 2006/0240254 | A1 * | 10/2006 | Kikuchi et al. | 428/375 | |
| 2010/0032184 | A1 * | 2/2010 | Honda et al. | 174/110 N | |
| 2010/0206611 | A1 | 8/2010 | Honda et al. | | |
| 2011/0127067 | A1 | 6/2011 | Honda et al. | | |
| 2011/0192632 | A1 | 8/2011 | Abe et al. | | |

(Continued)

FOREIGN PATENT DOCUMENTS

| | | |
|---|---|---|
| CN | 102081997 (A) | 6/2011 |
| JP | 63-221126 A | 9/1988 |

(Continued)

OTHER PUBLICATIONS

Japanese Office Action dated Jan. 6, 2015 with English Translation.

(Continued)

*Primary Examiner* — Chau N Nguyen
(74) *Attorney, Agent, or Firm* — McGinn IP Law Group, PLLC.

(57) ABSTRACT

An insulated wire includes a conductor, and an insulating covering layer including a first insulation layer formed around the conductor and a second insulation layer formed around the first insulation layer. An elastic modulus of the second insulation layer at 300° C. is not less than 300 MPa, and a relative permittivity of the insulating covering layer is not more than 3.0.

16 Claims, 1 Drawing Sheet

(56) References Cited

U.S. PATENT DOCUMENTS

| | | | | |
|---|---|---|---|---|
| 2012/0156459 | A1* | 6/2012 | Lu et al. | 428/216 |
| 2012/0231264 | A1* | 9/2012 | Auman et al. | 428/329 |
| 2013/0098656 | A1 | 4/2013 | Saito et al. | |

FOREIGN PATENT DOCUMENTS

| | | | | |
|---|---|---|---|---|
| JP | 09-106711 | A | | 4/1997 |
| JP | 2004-022184 | A | | 1/2004 |
| JP | 2005-96251 | | * | 4/2005 |
| JP | 2006-51800 | | * | 2/2006 |
| JP | 2006-312268 | | * | 11/2006 |
| JP | 2010-189510 | A | | 9/2010 |
| JP | 2011-9015 | A | | 1/2011 |
| JP | 2011-165485 | A | | 8/2011 |
| JP | 2012-153848 | A | | 8/2012 |

OTHER PUBLICATIONS

Japanese Office Action dated Sep. 29, 2015 with English Translation.
Chinese Office Action dated Sep. 15, 2015 with an English translation.

* cited by examiner

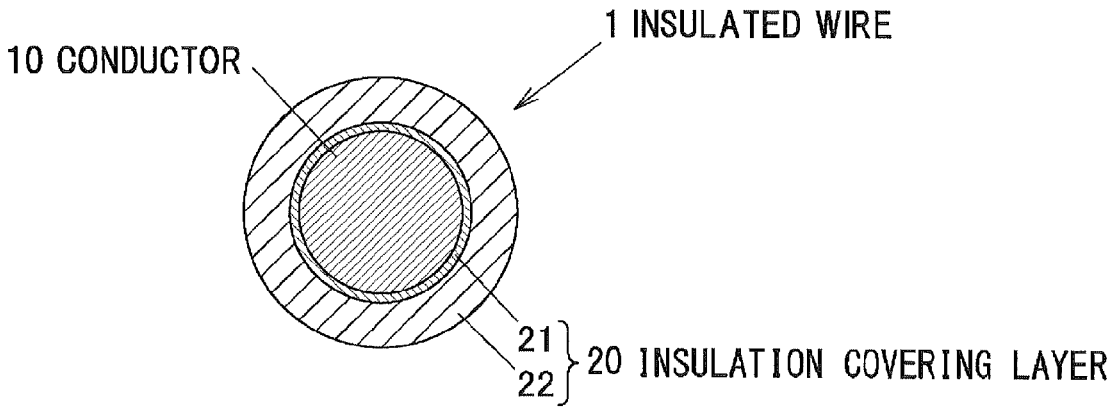
1 INSULATED WIRE
10 CONDUCTOR
21
22
20 INSULATION COVERING LAYER

INSULATED WIRE AND COIL

The present application is based on Japanese patent application No. 2011-280844 filed on Dec. 22, 2011, the entire contents of which are incorporated herein by reference.

BACKGROUND OF THE INVENTION

1. Field of the Invention

The invention relates to an insulated wire and a coil using the insulated wire.

2. Description of the Related Art

Electric equipment, in which a coil formed by welding and bonding the end portions of insulated wires is used, are desired to be small and to be driven at high voltage so as to improve the performance. Therefore, there is a tendency that electric equipments are inverter-controlled at higher voltage than before and a value of inverter surge voltage generated by the inverter control thus rises, which results in that the insulated wires are used under an environment in which partial discharge is more likely to occur than before.

Thus, in recent years, the insulated wires are desired to have a higher partial discharge inception voltage than a conventional insulated wire so as to suppress the occurrence of partial discharge caused by an increase in inverter surge voltage.

An insulated wire with a high partial discharge inception voltage is known in which plural layers of insulating covering films made of a specific material are formed on a conductor (see, e.g., JP-A-2011-165485). Here, the plural layers of insulating covering films include first and second covering film layers. The first covering film layer is formed of a first resin composition formed by graft-polymerizing a graft compound onto an ethylene-tetrafluoroethylene copolymer and the second covering film layer is formed of a second resin composition as a polymer alloy composed of a polyphenylene sulfide resin and a polyamide resin.

JP-A-2011-165485 discloses that excellent abrasion resistance and heat resistance of the second resin composition constituting the second coating layer can be obtained when a storage elastic modulus at 20° C. is not less than 1 GPa and a storage elastic modulus at 200° C. is not less than 10 MPa.

SUMMARY OF THE INVENTION

On the other hand, recently, to increase a space factor of the insulated wire constituting a coil has been proposed in order to downsize a motor and drive it at high voltage. This causes a decrease in heat dissipation of the coil or a large increase in electric current flown through the coil, so that the insulated wire constituting the coil has to be used under a high-temperature environment (e.g., not less than 220° C.).

Thus, in order to prevent the deterioration or damage of the insulating covering layer caused by the partial discharge even under the high-temperature environment, an insulated wire is desired that the partial discharge is less likely to occur under the high-temperature environment.

As described above, other than the insulated wire with a high partial discharge inception voltage at ambient temperature, an insulated wire less likely to cause the partial discharge even under severe circumstances such as a high temperature use environment is demanded.

Accordingly, it is an object of the invention to provide an insulated wire that has a high partial discharge inception voltage under the high-temperature environment and a coil formed using the insulated wire.

(1) According to one embodiment of the invention, an insulated wire comprises:

a conductor; and an insulating covering layer comprising a first insulation layer formed around the conductor and a second insulation layer formed around the first insulation layer, wherein an elastic modulus of the second insulation layer at 300° C. is not less than 300 MPa, and a relative permittivity of the insulating covering layer is not more than 3.0.

In the above embodiment (1) of the invention, the following modifications and changes can be made.

(i) An elastic modulus of the second insulation layer at 350° C. is not less than 1 MPa.

(ii) A dielectric loss tangent of the insulating covering layer is not less than 5% and not more than 20%.

(iii) The second insulation layer comprises a resin containing at least one of a polyimide resin, a polyamide-imide resin and a polyester imide resin.

(iv) The first insulation layer comprises a resin having an imide group in a molecule thereof.

(v) The insulated wire further comprises:

a lubricant layer having lubricity on the second insulation layer.

(vi) The first insulation layer comprises an additive that improves adhesion with the conductor.

(2) According to another embodiment of the invention, a coil comprises the insulated wire according to the above embodiment (1).

Effects of the invention

According to one embodiment of the invention, an insulated wire can be provided that has a high partial discharge inception voltage under the high-temperature environment, as well as a coil formed using the insulated wire.

BRIEF DESCRIPTION OF THE DRAWINGS

Next, the present invention will be explained in more detail in conjunction with appended drawings, wherein:

FIG. 1 is a cross sectional view showing an insulated wire in an embodiment of the present invention.

DETAILED DESCRIPTION OF THE PREFERRED EMBODIMENTS

Embodiment

FIG. 1 shows an example of a cross section of an insulated wire 1 in the present embodiment. The insulated wire 1 in the present embodiment has a conductor 10 and an insulating covering layer 20 covering the conductor 10.

In the insulated wire 1, a partial discharge inception voltage is high at ambient temperature (e.g., 25° C.) as well as at high temperature (e.g., 220° C.), and a difference between the partial discharge inception voltage at ambient temperature and that at high temperature is small. In a general insulated wire, a partial discharge inception voltage at ambient temperature is low, and also a difference between the partial discharge inception voltage at ambient temperature and that at high temperature is large. Therefore, the partial discharge inception voltage greatly decreases when placed under a high-temperature environment and partial discharge is highly likely to occur.

The conductor 10 is a conductor line formed of a conductive material such as copper. As the copper, oxygen-free copper and low oxygen copper, etc., are mainly used. In addition, the conductor 10 may have a multilayer structure and may be, e.g., a copper wire with a metal such as nickel plated on a surface thereof. A cross sectional shape of the conductor 10 is, e.g., circular or rectangular. Note that, the rectangular shape here includes a rectangle with rounded corners.

The insulating covering layer 20 includes a first insulation layer 21 formed around the conductor 10 and a second insulation layer 22 formed around the first insulation layer 21. The insulating covering layer 20 may be formed on the conductor 10 via another layer such as adhesion layer.

A relative permittivity of the insulating covering layer 20 is not more than 3.0. When the relative permittivity is greater than 3.0, a partial discharge inception voltage of the insulated wire 1 is low at ambient temperature (e.g., 25° C.) as well as at high temperature (e.g., 220° C.), and there is concern that partial discharge due to inverter surge voltage occurs in the insulated wire, leading to breakdown.

In addition, it is preferable that the insulating covering layer 20 have tan δ of not less than 5% and not more than 20%. Here, tan δ indicates a dielectric loss tangent. Mechanical characteristics of the insulating covering layer, such as flexibility, decrease when tan δ is less than 5% while a high partial discharge inception voltage in a high temperature region or good weldability may not be obtained when tan δ is more than 20%.

Tan δ can be controlled within the above-mentioned range by appropriately adjusting time of baking an insulating coating material applied to an outer periphery of the conductor when forming the insulating covering layer. The time until the insulating coating material applied to the outer periphery of the conductor is baked is controlled by adjusting, e.g., a feeding speed of the conductor in a production line or a baking temperature in a baking furnace.

The first insulation layer 21 is formed by applying and baking an insulating coating material (hereinafter, referred to as a "first insulating coating material") on the conductor 10 or on another layer preliminarily formed on the conductor 10.

The first insulating coating material is an insulating coating material in which a resin having an imide group in a molecule thereof, e.g., a polyimide resin, a polyamide-imide resin or a polyester-imide resin, etc., is dissolved in an organic solvent.

In more detail, the first insulating coating material is, e.g., an insulating coating material in which a polyimide resin formed by mixing a tetracarboxylic dianhydride made of pyromellitic dianhydride (PMDA), etc., with a diamine compound made of 4,4'-diaminodiphenyl ether (ODA) at equimolar amounts is dissolved in an organic solvent such as N-methyl-2-pyrrolidone, an insulating coating material in which a polyamide-imide resin formed by mixing a tricarboxylic acid anhydride such as trimellitic anhydride (TMA) with an isocyanate such as 4,4'-diphenylmethane diisocyanate (MDI) at equimolar amounts is dissolved in an organic solvent, or an insulating coating material formed of a polyester-imide resin modified with tris(2-hydroxyethyl) isocyanurate.

Alternatively, a commercially available insulating coating material may be used as the first insulating coating material and it is possible to use, e.g., a polyimide resin insulating coating material such as Torayneece#3000 manufactured by Toray Industries, Inc. or Pyre-ML manufactured by DuPont, a polyamide-imide resin insulating coating material such as HI406 manufactured by Hitachi Chemical Co., Ltd., and a polyester-imide resin insulating coating material such as Isomid40SM45 manufactured by Hitachi Chemical Co., Ltd.

In addition, the first insulating coating material may contain an additive which improves adhesion with the conductor 10, such as adhesion improver. The adhesion improver is, e.g., a melamine-based compound such as alkylated hexamethylol melamine resin.

The second insulation layer 22 is formed by applying and baking an insulating coating material (hereinafter, referred to as a "second insulating coating material") on the first insulation layer 21.

A storage elastic modulus of the second insulation layer 22 at 300° C. is not less than 300 MPa. In addition, it is preferable that the storage elastic modulus of the second insulation layer 22 at 350° C. be not less than 1 MPa. When the storage elastic modulus of the second insulation layer 22 at 300° C. is less than 300 MPa, a partial discharge inception voltage in a high temperature region may greatly decrease leading to breakdown, and also, foam, etc., may be generated more frequently around a joint of the insulating covering layer 20 when bonding the insulated wire 1 by welding.

The second insulating coating material is an insulating coating material formed of a resin containing at least one of, e.g., polyimide, polyamide-imide and polyester-imide. In more detail, the second insulating coating material is, e.g., a polyimide obtained by reacting one or more aromatic tetracarboxylic dianhydrides such as pyromellitic dianhydride (PMDA) and 2,2-bis[4-(3,4-dicarboxyphenoxy)phenyl]propane dianhydride (BPADA), etc., with one or more aromatic diamines such as 2,2-bis[4-(4-aminophenoxy)phenyl]propane (BAPP), 4,4'-bis(4-aminophenoxy)biphenyl (BAPB), 3,3'-bis(4-aminophenoxy)biphenyl (M-BAPB), bis[4-(4-aminophenoxy)phenyl]sulfone (BAPS) and 1,3-bis(4-aminophenoxy)benzene (TPE-R), etc. Note that, 4,4'-diaminodiphenyl ether (ODA) may be used together as the above-mentioned aromatic diamine.

In addition, a dianhydride other than pyromellitic dianhydride may be copolymerized as a raw material within a range allowing the second insulation layer 22 having a storage elastic modulus at 300° C. of not less than 300 MPa to be formed.

Note that, an insulating coating material for forming an insulation layer of which storage elastic modulus at less than 300° C. is less than 300 MPa, such as a polyamide resin consisting mainly of straight-chain aliphatic series, is not included as the second insulating coating material.

The insulated wire 1 may have a lubricity-imparting layer for imparting lubricity, a scratch resistance-imparting layer for imparting scratch resistance, a flexibility-imparting layer or an adhesion-imparting layer, etc., on the insulating covering layer 20. It is preferable that these layers be formed by applying and baking an insulating coating material on the insulating covering layer 20, or between the conductor 10 and the first insulation layer 21, or between the first insulation layer 21 and the second insulation layer 22.

In addition, by using the insulated wire 1, it is possible to form a coil as a component of, e.g., an electric equipment such as motor or generator.

Effects of the Embodiment

Since, in the insulated wire 1 of the present embodiment, a partial discharge inception voltage is high at ambient temperature as well as at high temperature and also a difference between the partial discharge inception voltage at ambient temperature and that at high temperature is small, it is possible to suppress occurrence of partial discharge even when used under a high-temperature environment. In addition, it is possible to use the insulated wire to form a coil having the same features.

EXAMPLES

Insulating coating materials were made under conditions shown in the following Examples 1 to 4 and Comparative Examples 1 and 2, and insulating covering layers of insulated wires were made using the respective insulating coating materials. Subsequently, tan δ, relative permittivity and storage elastic modulus were measured on each insulated wire, and then, flexibility and TIG (Tungsten Inert Gas) weldability were evaluated.

Manufacturing of the Insulated Wire

Firstly, the first insulating coating material as a material of a first insulation layer which corresponds to the first insulation layer 21 in the embodiment was synthesized. As the first insulating coating material, the same insulating coating material was used in Examples 1 to 4 and Comparative Examples 1 and 2. The method for the synthesis thereof will be described below.

Pyromellitic dianhydride (PMDA) and 4,4'-diaminodiphenyl ether (ODA) were mixed at equimolar amounts in a flask provided with a stirrer, a reflux cooling tube, a nitrogen inlet tube and a thermometer. Then, N-methyl-2-pyrrolidone was mixed thereto so that a solid content concentration is 15 wt % and reaction was subsequently carried out at room temperature for 12 hours, thereby obtaining the first insulating coating material.

Processes after obtaining the first insulating coating material will be described below for each of Examples 1 to 4 and Comparative Examples 1 and 2.

Example 1

Pyromellitic dianhydride (PMDA) and 2,2-bis[4-(4-aminophenoxy)phenyl]propane (BAPP) were mixed at equimolar amounts in a flask provided with a stirrer, a reflux cooling tube, a nitrogen inlet tube and a thermometer. Then, N-methyl-2-pyrrolidone was mixed thereto so that a solid content concentration is 15 wt % and reaction was subsequently carried out at room temperature for 12 hours, thereby obtaining a second insulating coating material A.

Next, the first insulating coating material was applied and baked on a conductor having an outer diameter of 0.8 mm, thereby forming a 0.002 mm-thick first insulation layer. After that, the second insulating coating material A was repeatedly applied and baked on the first insulation layer to form a 0.038 mm-thick second insulation layer. As a result, an insulated wire having an insulating covering layer with a total thickness of 0.040 mm was obtained.

Example 2

Pyromellitic dianhydride (PMDA) and 1,3-bis(4-aminophenoxy)benzene (TPE-R) were mixed at equimolar amounts in a flask provided with a stirrer, a reflux cooling tube, a nitrogen inlet tube and a thermometer. Then, N-methyl-2-pyrrolidone was mixed thereto so that a solid content concentration is 15 wt % and reaction was subsequently carried out at room temperature for 12 hours, thereby obtaining a second insulating coating material B.

Next, the first insulating coating material was applied and baked on a conductor having an outer diameter of 0.8 mm, thereby forming a 0.002 mm-thick first insulation layer. After that, the second insulating coating material B was repeatedly applied and baked on the first insulation layer to form a 0.038 mm-thick second insulation layer. As a result, an insulated wire having an insulating covering layer with a total thickness of 0.040 mm was obtained.

Example 3

The second insulating coating material A was obtained by the same synthesis method as Example 1. Next, the first insulating coating material was applied and baked on a conductor having an outer diameter of 0.8 mm, thereby forming a 0.002 mm-thick first insulation layer. After that, the second insulating coating material A was repeatedly applied and baked on the first insulation layer to form a 0.038 mm-thick second insulation layer. As a result, an insulated wire having an insulating covering layer with a total thickness of 0.040 mm was obtained.

Example 4

The second insulating coating material A was obtained by the same synthesis method as Example 1. Next, the first insulating coating material was applied and baked on a conductor having an outer diameter of 0.8 mm, thereby forming a 0.002 mm-thick first insulation layer. After that, the second insulating coating material A was repeatedly applied and baked on the first insulation layer to form a 0.038 mm-thick second insulation layer. As a result, an insulated wire having an insulating covering layer with a total thickness of 0.040 mm was obtained.

Comparative Example 1

A 0.040 mm-thick first insulation layer was formed by applying and baking the first insulating coating material on a conductor having an outer diameter of 0.8 mm, thereby forming an insulated wire. In Comparative Example 1, the second insulation layer was not formed and the insulating covering layer was thus composed of only the first insulation layer.

Comparative Example 2

4,4'-oxydiphthalic dianhydride (ODPA) and 3,4'-diaminodiphenyl ether were mixed at equimolar amounts in a flask provided with a stirrer, a reflux cooling tube, a nitrogen inlet tube and a thermometer. Then, N-methyl-2-pyrrolidone was mixed thereto so that a solid content concentration is 15 wt % and reaction was subsequently carried out at room temperature for 12 hours, thereby obtaining a second insulating coating material C.

Next, the first insulating coating material was applied and baked on a conductor having an outer diameter of 0.8 mm, thereby forming a 0.002 mm-thick first insulation layer. After that, the second insulating coating material C was repeatedly applied and baked on the first insulation layer to form a 0.038 mm-thick second insulation layer. As a result, an insulated wire having an insulating covering layer with a total thickness of 0.040 mm was obtained.

Measurement of Partial Discharge Inception Voltage

The insulated wire was cut into a length of 500 mm and ten samples of twisted-pair insulated wires were made. Then, an end processed portion was formed by removing the insulating covering layer to a position of 10 mm from an edge of the sample. Following this, the end processed portion was connected to an electrode and 50 Hz of voltage was applied in an atmosphere at a temperature of 25° C. and humidity of 50% or in an atmosphere at 200° C.

After that, voltage was increased at a rate of 10 to 30 V/s, and a voltage value at which 100 pC of discharge occurs 50 times per second in the sample was derived. This was repeated three times and an average value of three voltage values was defined as a partial discharge inception voltage.

Measurement of Tan δ

A test piece having a length of about 40 cm was cut out from the insulated wire, was placed on a tan δ measuring instrument, and was immersed in a low-melting-point metal (an alloy of Bi, In, Pb and Sn) which was preliminarily maintained at a predetermined temperature in an electrode tank. Then, 1 kHz of frequency was applied using an LCR meter and a dielectric loss tangent was measured.

Measurement of Relative Permittivity

The insulated wire was cut into a length of 250 mm and was elongated 2%, and the insulating covering layer at one edge was removed. After heat treatment at 120° C. for 30 minutes, an electrode was formed by platinum sputtered on the insulated wire, thereby obtaining a sample. Capacitance of the sample was measured using a commercially available impedance analyzer (frequency: 1 kHz) and the relative permittivity ($\in_s$) was calculated based on the following formula 1.

$$\in_s=(C/2\pi\in_0)\times In(D/d)\times(1/L) \quad \text{(formula 1)}$$

Here, C represents capacitance of the measured sample, $\in_0$ represents permittivity of vacuum, D represents an outer diameter of the sample, d represents an outer diameter of the conductor of the sample and L represents a length of the electrode.

Measurement of Storage Elastic Modulus

A storage elastic modulus was measured on the second insulating coating materials which were used for forming the second insulation layers of Examples 1 to 4 and Comparative Example 2. Meanwhile, a storage elastic modulus of the first insulating coating material was measured for Comparative Example 1 since only the first insulation layer is formed without forming the second insulation layer.

Firstly, a sheet-like insulating film for evaluation in a size of 5 mm×20 mm×25 μm (thickness) was made using each insulating coating material. Then, a storage elastic modulus of the insulating film for evaluation at oscillation of 100 Hz was measured using a dynamic viscoelastic measurement apparatus (DVA-200, manufactured by IT Keisoku Seigyo Co., Ltd.) while increasing the temperature from room temperature to 400° C. at 10° C./min.

Evaluation of Flexibility

A test piece taken from the insulated wire was wound around a winding bar having a diameter 1 to 10 times a diameter (d) of the conductor of the test piece by a method in accordance with "JIS C 3003, 7.1.1a, Winding", and presence of occurrence of cracks on the insulating film was observed by an optical microscope. A minimum winding rod diameter (nd and n are integers) at which cracks are not present was recorded as a result.

Evaluation of TIG Weldability

After the insulating covering layer at the one edge of the insulated wire was removed about 5 mm from the tip, welding was carried out under conditions of 80 A and 0.4 second by a TIG welding equipment. As a result, the samples without occurrence of film separation or foam generation on the surface of the insulating covering layer in the vicinity of the welded portion were evaluated as "○ (passed the test)" and the samples with occurrence of film separation or foam generation were evaluated as "X (failed)".

Table 1 shows results of evaluations and measurements on the insulated wires in Examples 1 to 4 and Comparative Examples 1 and 2.

TABLE 1

| Items | | | Example 1 | Example 2 | Example 3 | Example 4 | Comparative Example 1 | Comparative Example 2 |
|---|---|---|---|---|---|---|---|---|
| Structure of Insulating covering layer | First insulation layer | Coating material | First insulating coating material | First insulating coating material | First insulating coating material | First insulating coating material | First insulating coating material | First insulating coating material |
| | | Film thickness (mm) | 0.002 | 0.002 | 0.002 | 0.002 | 0.040 | 0.002 |
| | Second insulation layer | Coating material | Second insulating coating material A | Second insulating coating material B | Second insulating coating material A | Second insulating coating material A | — | Second insulating coating material C |
| | | Film thickness (mm) | 0.038 | 0.038 | 0.038 | 0.038 | — | 0.038 |
| Relative permittivity | | | 3.0 | 3.0 | 3.0 | 3.0 | 3.4 | 2.9 |
| Storage elastic modulus (MPa) [300° C.] | | | 420 | 1800 | 1800 | 1800 | 1390 | <1 |
| Storage elastic modulus (MPa) [350° C.] | | | 3.5 | 1370 | 3.5 | 3.5 | 850 | <1 |
| tan δ [1 kHz, 280° C.] | | | 5 | 15 | 20 | 30 | 15 | 3 |
| Partial discharge inception voltage (Vp) | 25° C.-50% RH | | 1090 | 1090 | 1090 | 1090 | 950 | 1130 |
| | 220° C. | | 980 | 970 | 980 | 920 | 820 | 810 |
| TIG weldability | | | ○ | ○ | ○ | ○ | ○ | X |
| Flexibility | | | 1 d | 1 d | 1 d | 1 d | 1 d | 3 d |

The insulated wires in Examples 1 to 4 each have the second insulation layer having a storage elastic modulus at 300° C. of not less than 300 MPa, and a relative permittivity of the insulating covering layer is 3.0. On the other hand, the insulated wires in Comparative Examples 1 and 2 do not satisfy such conditions.

It was found that a partial discharge inception voltage at high temperature is higher in the insulated wires in Examples 1 to 4 than in the insulated wires in Comparative Examples 1 and 2.

It was found that the insulated wires especially in Examples 1 to 3, of which tan δ is within a range of not less than 5% and not more than 20%, have a partial discharge inception voltage at higher temperature and are excellent in weldability.

In addition, from the results of Examples 1 to 4 and Comparative Examples 1 and 2, it was found that a partial discharge inception voltage is less likely to decrease (a small decreasing rate) within a temperature range of ambient temperature (25° C.) to high temperature (220° C.) when the elastic modulus of the second insulation layer at 350° C. is not less than 1 MPa.

Although the embodiment and examples of the invention have been described, the invention according to claims is not to be limited to the above-mentioned embodiment and examples. Further, it should be noted that all combinations of the features described in the embodiment and examples are not necessary to solve the problem of the invention.

What is claimed is:

1. An insulated wire, comprising:

a conductor; and an insulating covering layer comprising a first insulation layer formed around the conductor and a second insulation layer formed around the first insulation layer, wherein a storage elastic modulus of the second insulation layer at 300° C. is not less than 300 MPa, and a relative permittivity of the insulating covering layer is not more than 3.0, wherein the second insulation layer comprises a resin containing at least one of a polyimide resin, a polyamide-imide resin, and a polyester imide resin, wherein the second insulation layer consists of polyimide, wherein the polyimide of the second insulation layer consists of aromatic tetracarboxylic dianhydrides and aromatic diamines, wherein the aromatic tetracarboxylic dianhydrides consist of pyromellitic dianhydride (PMDA) and 3,3',4,4'-biphenyltetracarboxylic dianhydride (BPDA), and wherein the aromatic diamines consist of 4,4'-bis(4-aminophenoxy)biphenyl (BAPB) and 4,4'-diaminodiphenyl ether (ODA).

2. The insulated wire according to claim 1, wherein the storage elastic modulus of the second insulation layer at 350° C. is not less than 1 MPa.

3. The insulated wire according to claim 1, wherein a dielectric loss tangent of the insulating covering layer is not less than 5% and not more than 20%.

4. The insulated wire according to claim 1, wherein the first insulation layer comprises a resin comprising an imide group in a molecule thereof.

5. The insulated wire according to claim 1, further comprising:

a lubricant layer having lubricity on the second insulation layer.

6. The insulated wire according to claim 1, wherein the first insulation layer comprises an additive that improves adhesion with the conductor.

7. A coil comprising the insulated wire according to claim 1.

8. The insulated wire according to claim 1, wherein the first insulation layer comprises an insulating coating material in which at least one of polyimide resin, polyamide-imide resin, and polyester-imide resin is dissolved in an organic solvent.

9. The insulated wire according to claim 1, wherein the first insulation layer comprises an insulating coating material in which a polyimide resin formed by mixing a tetracarboxylic dianhydride comprising pyromellitic dianhydride (PMDA) with a diamine compound comprising 4,4'-diaminodiphenyl ether (ODA) at equimolar amounts is dissolved in an organic solvent.

10. The insulated wire according to claim 9, wherein the organic solvent comprises N-methyl-2-pyrrolidone.

11. The insulated wire according to claim 1, wherein the first insulation layer comprises an insulating coating material in which a polyamide-imide resin formed by mixing a tricarboxylic acid anhydride comprising trimellitic anhydride (TMA) with an isocyanate comprising 4,4'-diphenylmethane diisocyanate (MDI) at equimolar amounts is dissolved in an organic solvent.

12. The insulated wire according to claim 1, wherein the first insulation layer comprises an insulating coating material that comprises a polyester-imide resin modified with tris(2-hydroxyethyl) isocyanurate.

13. The insulated wire according to claim 1, wherein the polyimide of the second insulation layer is obtained by a reaction of the aromatic tetracarboxylic dianhydrides with the aromatic diamines.

14. The insulated wire according to claim 1, wherein the first insulation layer of the insulating covering layer is disposed on a surface of the second insulation layer of the insulating covering layer.

15. The insulated wire according to claim 1, wherein the first insulation layer of the insulating covering layer comprises a polyimide resin insulating coating material.

16. The insulated wire according to claim 1, wherein an outer surface of the conductor abuts an inner surface of the first insulation layer of the insulating covering layer, and wherein an outer surface of the first insulation layer of the insulating covering layer abuts an inner surface of the second insulation layer of the insulating covering layer.

* * * * *